United States Patent [19]

Caraway

[11] 4,281,672

[45] Aug. 4, 1981

[54] SMOKING DEVICE

[76] Inventor: Ricky E. Caraway, 325 Robin Ct., Burleson, Tex. 76028

[21] Appl. No.: 101,579

[22] Filed: Dec. 10, 1979

[51] Int. Cl.[3] ..... A24F 13/16

[52] U.S. Cl. ..... 131/174; 131/240 GG

[58] Field of Search ..... 131/240, 241, 231, 235, 131/174, 175

[56] References Cited

U.S. PATENT DOCUMENTS

| | | | |
|---|---|---|---|
| 1,688,008 | 10/1928 | Engl | 131/240 R |
| 2,639,718 | 5/1953 | Chewhocklong | 131/240 R X |
| 2,894,514 | 7/1959 | Moore | 131/174 |
| 3,276,455 | 10/1966 | Blanchard | 131/240 GG |
| 4,194,516 | 3/1980 | Morgan | 131/174 |

*Primary Examiner*—Stephen C. Pellegrino

*Attorney, Agent, or Firm*—Arthur F. Zobal

[57] ABSTRACT

A container having an open end and a closed end with a holding means pivotally coupled to the container at its open end for holding a cigarette. The holding means may be pivoted to an outside position for allowing the cigarette to be lit and to an inside position for smoking purposes wherein the burning end of the cigarette is located inside of the container and the butt end of the cigarette is located outside of the container.

2 Claims, 4 Drawing Figures

Fig. 1
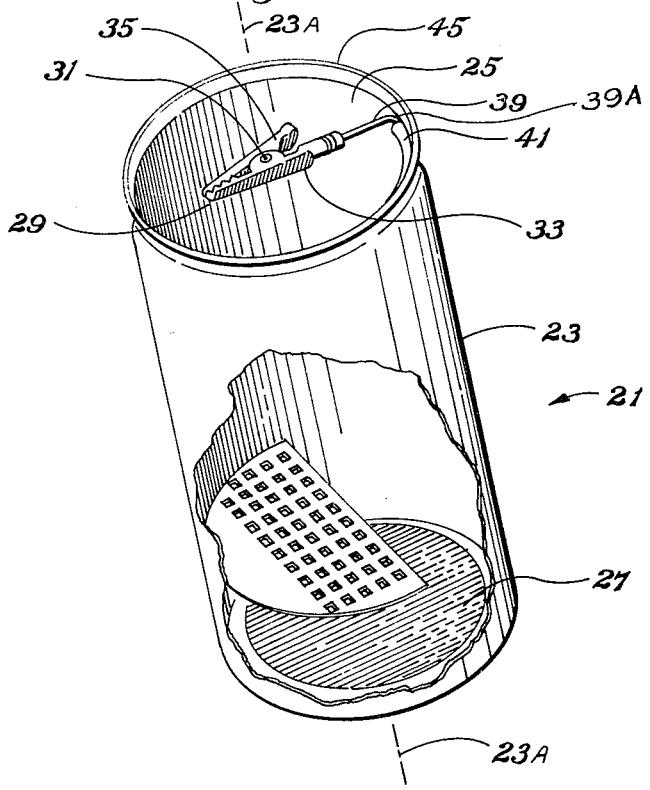
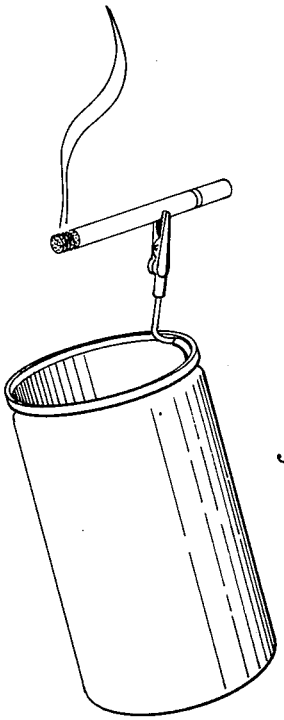
Fig. 2
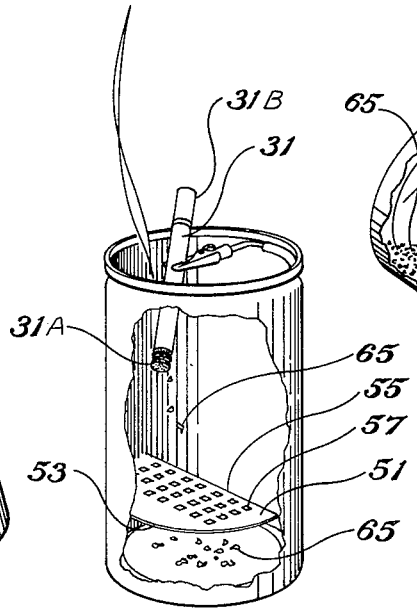
Fig. 3
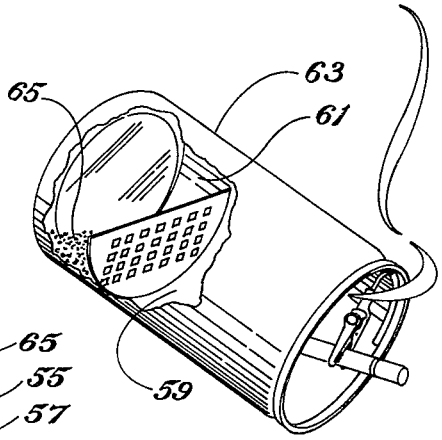
Fig. 4

SMOKING DEVICE

FIELD OF THE INVENTION

The present invention relates to a device for holding a cigarette while it is being smoked.

SUMMARY OF THE INVENTION

In accordance with the present invention, there is provided a new and unique smoking device comprising a container having an open end and closed bottom, and holding means coupled to the container at said open end for holding a cigarette or the like. The holding means is movable between a first position where a first portion of the cigarette held by the holding means is within the container and a second position where the cigarette is outside of the container. In the first position, the holding means is capable of holding the burning end of the cigarette within the container with the butt end of the cigarette outside of the container. In the embodiment disclosed, the holding means is pivotally coupled to the container at said open end.

In a further aspect, there is provided baffle means located in the container between said open end and said bottom and next to a portion of the side wall of the container for allowing ashes to fall to the bottom of the container but preventing ashes between said bottom and said baffle means from falling out of the container when the container is positioned with its open end downward and with said portion of said side wall in a lower position relative to the opposite side wall portion.

BRIEF DESCRIPTION OF THE DRAWINGS

FIG. 1 is a perspective view of the smoking device of the present invention with a portion of the side wall of its container removed to illustrate a baffle located on the inside.

FIG. 2 illustrates the device of FIG. 1 with its cigarette holding means positioned outside of the container.

FIG. 3 illustrates the device of FIG. 1 with its cigarette holding means positioned to locate the burning end of the cigarette within the container and the butt end outside of the container. A portion of the side wall of the container has been removed to illustrate the inside of the container.

FIG. 4 illustrates the device of FIG. 1 with its cigarette holding means in the same position as in FIG. 3 and with the open end of the container in a downward position. A portion of the side wall of the container has been removed to illustrate the inside of the container.

DESCRIPTION OF THE PREFERRED EMBODIMENTS

Referring now to FIGS. 1–4 of the drawings, the device of the present invention is identified at 21. It comprises a cylindrical container 23 having an open end 25 and a closed bottom 27. The container is light in weight and preferably is formed of metal. Coupled to the container 23 at its open end 25 is a holding means 29 for holding a cigarette or the like illustrated at 31 in FIGS. 2–4. The holding means shown is an alligator clip having two jaws 33 and 35 pivotally coupled together by a pin 37 which defines the pivot axis of the jaws. The jaws normally are biased to a closed position by a spring not shown. Jaw 33 is connected to an arm 39 which has a bent portion 39A located in a sleeve 41 secured to the inside wall of the container near but below the top edge 43 of the container. The arm 39 and hence the clip 29 may be pivoted from the position shown in FIGS. 1, 3 and 4 to the position shown in FIG. 2 wherein the clip is located above the upper edge 43 and outside of the container. In the position of FIGS. 1, 3 and 4, the clip is within the container extending generally transversed to the axis of the container with its pivot pin 37 generally parallel with the axis of the container. Thus in the position of FIGS. 1, 3 and 4, the clip 29 is capable of holding a cigarette such that its burning end 31A is within the container and its butt end 31B is outside of the container. When the clip is in the position of FIG. 2, its pivot pin 37 is generally transversed to the axis of the container whereby the clip 29 is capable of holding the cigarette completely outside of the container.

Secured within the container between its bottom 27 and open end 25 is a baffle plate 51 compising a half circular eged 53 and a straight edge 55. The plate 51 has a plurality of apertures 57 formed therethrough. The half circular edge 53 is secured to a portion 59 of the side wall of the container between the bottom 27 and the open end 25 whereby a passage 61 is formed between the straight edge 55 of the baffle plate 51 and the opposite side wall portion 63 of the container.

In using the device 21, the clip 29 is moved to the position shown in FIG. 2 and its jaws 33 and 35 spread apart for receiving a cigarette. In this position, the end 31A of the cigarette 31 is lit. The clip 29 then is moved to the position shown in FIGS. 1, 3 and 4 to allow the cigarette to be smoked with its burning end 31A within the container and its butt end 31B outside of the container. The cigarette may be smoked with the open end 25 of the container in an upward position as shown in FIG. 3 or with the open end 25 of the container in a downward position as shown in FIG. 4. In either position, the opening 25 is wide enough to allow sufficient air into the container to allow smoking to take place. Since the cigarette can be smoked while the container is in the position of FIG. 4, smoking can be easily done while a person is in bed or while riding in an automobile. The container can be turned to the position of FIG. 3 to allow ashes 65 to fall to the bottom 27 through passage 61 or through apertures 57 formed through the baffle plate 51. When the container 23 is turned with its opening 25 downward and the circular edge 53 of the pate 51 in a downward position as shown in FIG. 4, the plate 51 acts as a baffle and prevents the ashes 65 caught between the bottom 27 and plate 51 from moving downward beyond the plate.

In FIGS. 2–4, the clip 29 is shown holding the cigarette at an position spaced from its butt end. It is to be understood that the cigarette may be held by the clip 29 at a position closer to its butt end.

Although not shown, a lid may be employed to cover the open end 25 of the container 23 when the device is not in use.

The container 23 may have a soft drink emblem or mark formed on its exterior whereby when a cigarette is being smoked with the container in a position of FIG. 4 while the person is driving an automobile, a person outside of the automobile will think the driver is drinking a soft drink.

In one embodiment, the cylindrical container 23 may have a diameter of about 2½ inches and a height of about 5 inches. Although an alligator clip 29 is shown holding a cigarette, it is to be understood that other types of clips or clamps may be employed instead.

I claim:

1. A smoking device, comprising:

a container having an open end and a closed bottom, holding means coupled to said container at said open end for holding a cigarette or the like, said holding means being movable between a first position where a portion of the cigarette held by said holding means is within said container and a second position where the cigarette is outside of said container, and baffle means located in said container between said open end and said bottom and in contact with a portion of the side wall of said container for allowing ashes to fall to the bottom of said container but preventing ashes between said bottom and said baffle means from falling out of said container when said container is positioned with its open end downward and with said portion of said side wall in a lower position relative to the opposite side wall portion.

2. A smoking device, comprising:

a cylindrically shaped container having an open end and a closed bottom, holding means pivotally coupled to said container at said open end for holding a cigarette or the like, said holding means being pivotally movable between first and second positions for holding a cigarette in said first and second positions, said holding means comprising jaws pivotally coupled together for relative movement about a pivot axis, in said first position, said holding means being in alignment with the open end of said container and having the pivot axis of its jaws generally parallel to the axis of said container, in said second position, said holding means being located outside of said container with the pivot axis of its jaws generally transverse to the axis of said container, and plate means located in said container between said open end and said bottom, said plate means comprising an arcuate shaped edge secured to a portion of the inside wall of the container and a second edge spaced from the opposite side wall portion of said container providing a passage for allowing ashes to fall to the bottom of said container, p1 said plate means preventing ashes between said bottom of said container and said plate means from falling out of the container when said container is positioned with its open end downward and with said arcuate edge of said plate means in a downward position.

* * * * *